US012601141B2

(12) United States Patent
Storvik

(10) Patent No.: US 12,601,141 B2
(45) Date of Patent: Apr. 14, 2026

(54) SUCTION GENERATION DEVICE

(71) Applicant: WESUBSEA AS, Kristiansund (NO)

(72) Inventor: Kjell Storvik, Kristiansund (NO)

(73) Assignee: KONTORVEIEN 1 AS, Kristiansund (NO)

( * ) Notice: Subject to any disclaimer, the term of this patent is extended or adjusted under 35 U.S.C. 154(b) by 421 days.

(21) Appl. No.: 18/029,655

(22) PCT Filed: Oct. 15, 2021

(86) PCT No.: PCT/NO2021/050214
§ 371 (c)(1),
(2) Date: Mar. 30, 2023

(87) PCT Pub. No.: WO2022/086338
PCT Pub. Date: Apr. 28, 2022

(65) Prior Publication Data

US 2023/0407592 A1 Dec. 21, 2023

(30) Foreign Application Priority Data

Oct. 22, 2020 (NO) ..... 20201145

(51) Int. Cl.
*E02F 3/88* (2006.01)
*E02F 3/92* (2006.01)

(52) U.S. Cl.
CPC ..... *E02F 3/925* (2013.01); *E02F 3/8866* (2013.01)

(58) Field of Classification Search
CPC ..... E02F 3/8866; E02F 3/925
See application file for complete search history.

(56) References Cited

U.S. PATENT DOCUMENTS 3,932,281 A 1/1976 Pansini
3,975,842 A * 8/1976 Andreae ..... E02F 3/925 299/9

(Continued)

FOREIGN PATENT DOCUMENTS

CN 207277924 U 4/2018
EP 2707548 A1 3/2014

(Continued)

OTHER PUBLICATIONS

The office action issued in the corresponding Japanese application No. 2023-512781, mailed on May 26, 2025.

(Continued)

*Primary Examiner* — Matthew R Buck
(74) *Attorney, Agent, or Firm* — KILPATRICK TOWNSEND & STOCKTON LLP

(57) ABSTRACT

The disclosure relates to a suction generation device for the removal of matter from a submerged surface, including: a housing including a fluid inlet, a suction inlet, an expulsion outlet, and defining a cavity therein; the fluid inlet being configurable to direct a supply of fluid into the cavity and to establish a flowpath from the fluid inlet to the expulsion outlet, the flowpath extending through the cavity, and fluid flow in the flowpath generating a reduction in pressure at the suction inlet to generate a flow of fluid therethrough and into the flowpath; and the fluid inlet includes an array of inlet fluid ports. The disclosure further relates to an operation apparatus for the suction generation device and a method for the removal of matter from a submerged surface.

18 Claims, 3 Drawing Sheets

(56) References Cited

U.S. PATENT DOCUMENTS

| | | | | |
|---|---|---|---|---|
| 4,018,483 | A * | 4/1977 | Smith | B65G 53/42 15/409 |
| 4,070,061 | A * | 1/1978 | Obolensky | E02F 3/92 299/8 |
| 4,368,923 | A * | 1/1983 | Handa | E02F 3/9218 299/8 |
| 5,603,171 | A * | 2/1997 | Steinkuhler | E02F 7/065 37/321 |
| 8,091,255 | B2 * | 1/2012 | Drabble | E02F 3/9293 37/317 |
| 2016/0145884 | A1 | 5/2016 | Erlich et al. | |
| 2018/0127999 | A1 | 5/2018 | Durvasula et al. | |
| 2023/0074267 | A1 * | 3/2023 | De Bruyne | E21C 50/00 |

FOREIGN PATENT DOCUMENTS

| | | | |
|---|---|---|---|
| FR | 2953878 | A1 | 6/2011 |
| GB | 2413482 | A | 11/2005 |
| JP | S48104148 | U | 12/1973 |
| KR | 101386420 | B1 | 4/2014 |
| WO | 2012023676 | A1 | 2/2012 |
| WO | 2020172434 | A1 | 8/2020 |

OTHER PUBLICATIONS

ISR mailed Feb. 2, 2022 for PCT No. PCT/NO2021/050214.
NO Search Report reported Apr. 15, 2021 for NO App No. 20201145.

* cited by examiner

SUCTION GENERATION DEVICE

CROSS-REFERENCES TO RELATED APPLICATIONS

The present disclosure is a national phase application of International Application No. PCT/NO2021/050214, filed on Oct. 15, 2021, which claims priority to Norwegian Patent Application No. 20201145 filed with Norwegian Industrial Property Office on Oct. 22, 2020, the entireties of which are herein incorporated by reference.

FILED

The present disclosure relates to a suction generation device for the removal of matter from a submerged surface, an operation apparatus for the suction generation device and a method for the removal of matter from a submerged surface. More specifically, the disclosure relates to a suction generation device for the removal of matter from a submerged surface, an operation apparatus for the suction generation device and a method for the removal of matter from a submerged surface.

BACKGROUND

The collection of matter from a submerged surface may be desired for many reasons. For example in natural environments, such as the subsea environment, the build-up of sand, silt or sediment in some areas may be undesirable. In some other scenarios, for example in situations relating to environmental conservation, it may be desirable to remove larger matter such as sea urchins, or other water-dwelling pests, from a submerged surface or location.

In situations where subsea development (such as subsea construction) is required, the presence of an abundance of particulate matter such as sand may increase the difficulty of performing the desired developments. Therefore, the removal of this particulate matter is highly desirable.

The act of removing submerged matter, or dredging, may be performed by any appropriate means. For example, in the case of dredging, particulate matter may be physically scooped or pushed away from an area where development is required. This type of method may require the use of a crane and/or other heavy machinery, in order to scoop up or move the particulate matter. While such methods may achieve the goal of moving particulate matter away from a site of interest, the requirement for heavy machinery may result in this process being quite expensive. It may be more difficult to use such heavy machinery with a high degree of precision, which may require the dredging process to be repeated multiple times before a site of interest is sufficiently free of particulate matter. In addition, the use of heavy machinery may cause damage to the surrounding environment, which can increase the difficulty associated with any subsequent subsea developments, and it does not allow the user an opportunity to collect particulate matter, should this be desired.

Another method of dredging is to use suction to remove particulate matter. This method generally involves attaching a suction pipe to a vessel and pumping fluid with particulate matter entrained therein to the vessel, and depositing the fluid and matter in a separate location. Due to the high level of suction required, this method may be imprecise, and may also cause damage to the surrounding environment. While this method permits the removal and collection of particulate matter, it also produces a large volume of water and particulate matter, which then must be disposed of. Therefore, there exists a need for a device that enables more precise removal and optional collection of submerged matter, without the need for heavy equipment.

SUMMARY

Embodiments of the present disclosure may be to mitigate, alleviate or eliminate one or more of the above-identified deficiencies and disadvantages in the prior art and solve at least the above-mentioned problem. According to a first aspect there is provided a suction generation device for the removal of matter from a submerged surface, including: a housing including a fluid inlet, a suction inlet, an expulsion outlet, and defining a cavity therein; the fluid inlet being configurable to direct a supply of fluid into the cavity and to establish a flowpath from the fluid inlet to the expulsion outlet, the flowpath extending through the cavity, and fluid flow in the flowpath generating a reduction in pressure at the suction inlet to generate a flow of fluid therethrough and into the flowpath; and the fluid inlet includes an array of inlet fluid ports.

According to a second example, each of the inlet fluid ports includes a nozzle to direct fluid into the cavity.

According to a third example, each of the nozzles are located inside the cavity.

According to a fourth example, the array of inlet fluid ports is a linear array.

According to a fifth example, the array of inlet fluid ports is a rectangular array.

According to a sixth example, the suction inlet has an elongate shape.

According to a seventh example, the suction inlet has a rectangular shape.

According to an eighth example, the fluid inlet is located on, or defined by, a first wall of the housing, and the suction inlet is located on, or defined by, a second wall of the housing, and the first wall extends at right angles or an oblique angle to the second wall.

According to a ninth example, the fluid inlet and the suction inlet are located at a first end of the housing, and the expulsion outlet is located at a second end of the housing.

According to a tenth example, the first end and the second end are opposite ends of the housing.

According to an eleventh example, the suction inlet includes a lip for directing a fluid flow into the cavity.

According to a twelfth example, the fluid inlet directs a supply of fluid away from the suction inlet.

According to a thirteenth example, including a connection point for connection to an operation apparatus.

According to a second aspect there is provided an operation apparatus for the suction generation device of the first aspect, including: a connection profile for connecting the suction generation device thereto; a fluid supply conduit for supplying a fluid to the suction generation device; a drive arrangement for engaging a submerged surface and propelling the operation apparatus along the submerged surface; and the suction generation device is connected to the operation apparatus and the suction inlet is positioned adjacent the submerged surface, and is configurable to remove matter from the submerged surface through the suction inlet as the drive arrangement propels the operation apparatus along the submerged surface.

According to a first example of the second aspect, the drive arrangement includes an endless belt.

According to a second example of the second aspect, the suction inlet of the suction generation device is positioned to be substantially parallel to the submerged surface.

According to a third example of the second aspect, the suction inlet is located at or on a lower submerged surface-facing region of the operation apparatus.

According to a fourth example of the second aspect, the operation apparatus includes a pump to drive a fluid through the fluid inlet of the suction generation device.

According to a fifth example of the second aspect, the operation apparatus includes a motor to drive the drive arrangement.

According to a sixth example of the second aspect, the operation apparatus is remotely operable.

According to a third aspect there is provided a method for the removal of matter from a submerged surface, including: positioning a suction generation device including a drive arrangement on a submerged surface, the drive arrangement being configurable to engage the submerged surface; propelling the suction generation device along the submerged surface; providing suction via the suction generation device to dislodge and remove matter from the submerged surface.

According to a first example of the third aspect, the method includes remotely operating the suction generation device.

According to a second example of the third aspect, the method includes providing a flow of fluid to the suction generation device.

The present disclosure will become apparent from the detailed description given below. The detailed description and specific examples disclose some embodiments of the disclosure by way of illustration only. Guidance in the detailed description that changes and modifications may be made within the scope of the disclosure.

Hence, it is to be understood that the herein disclosed disclosure is not limited to the particular component parts of the device described or steps of the methods described since such device and method may vary. It is also to be understood that the terminology used herein is for purpose of describing particular embodiments only, and is not intended to be limiting. It should be noted that, as used in the specification and the appended claim, the articles "a", "an", "the", and "said" are intended to mean that there are one or more of the elements unless the context explicitly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTION OF THE DRAWINGS

The above embodiments of the present disclosure will be more fully appreciated by reference to the following illustrative and non-limiting detailed description of example embodiments of the present disclosure, when taken in conjunction with the accompanying drawings.

DETAILED DESCRIPTION OF THE DISCLOSURE

The present description provides an improved suction generation device for the removal of matter from submerged surface, operation apparatus for the suction generation device and method for the removal of matter from submerged surface. According to an example embodiment there is provided a suction generation device for the removal of matter from a submerged surface, including: a housing including a fluid inlet, a suction inlet, an expulsion outlet, and defining a cavity therein; the fluid inlet being configurable to direct a supply of fluid into the cavity and to establish a flowpath from the fluid inlet to the expulsion outlet, the flowpath extending through the cavity, and fluid flow in the flowpath generating a reduction in pressure at the suction inlet to generate a flow of fluid therethrough and into the flowpath; and the fluid inlet includes an array of inlet fluid ports.

In use, the suction generation device may provide a degree of suction while being connected to a fluid supply at the fluid inlet. The fluid inlet is configurable to receive a supply of fluid, and direct the supplied fluid towards the expulsion outlet, to define a flow path between the fluid inlet and expulsion outlet. The flow path passes by the suction inlet, causing suction at the suction inlet, to draw a fluid through the suction inlet and into the flow path. Having an array of fluid ports assists to allow an evenly distributed flow of fluid in the flowpath, to provide an evenly distributed suction across the area of the suction inlet. The suction generation device may be positioned on or above the submerged surface, and a fluid suppled at the fluid inlet to produce a suction at the suction port. The suction produced at the suction port is then able to remove, and may dislodge, matter from the submerged surface.

Figure 1B:
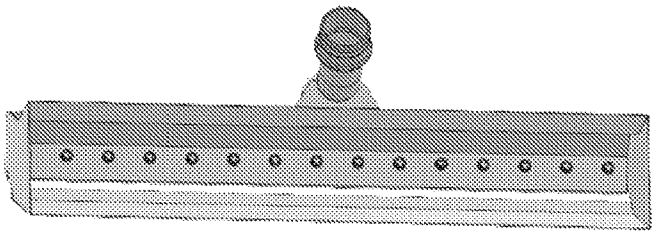
FIG. 1 shows some perspective views of a suction generation device.
Figure 1C:
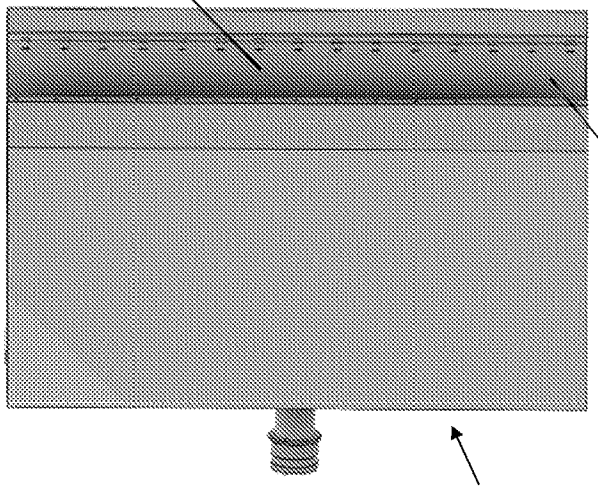
Figure 1A:
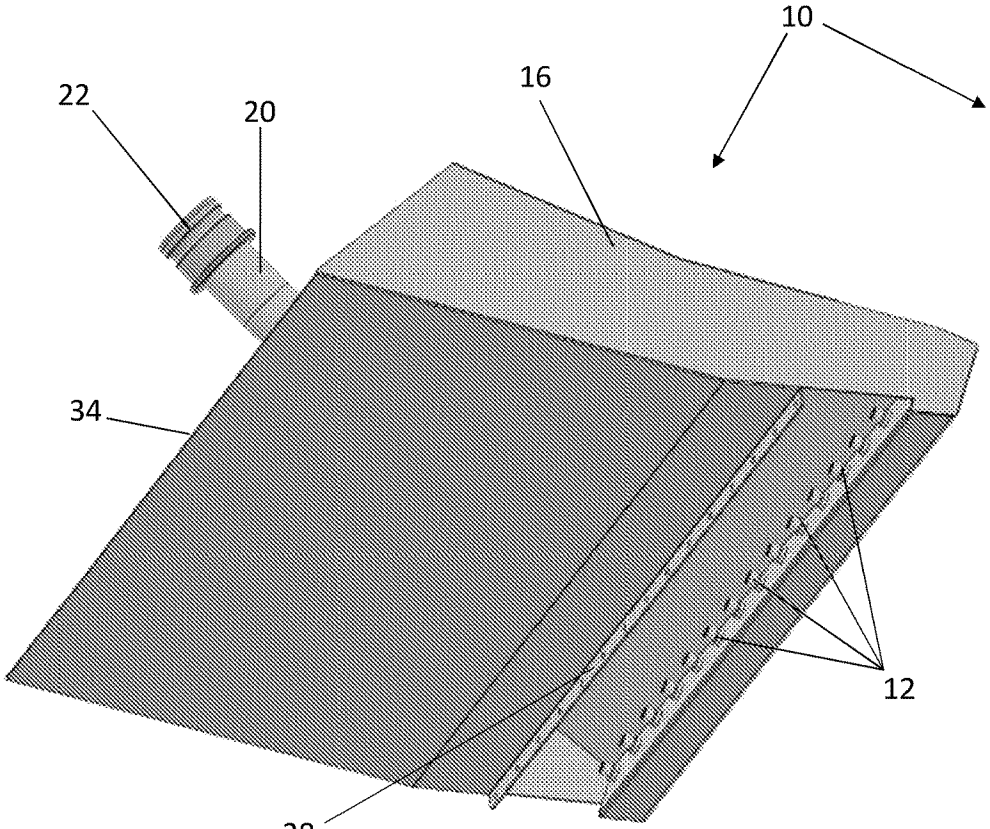

FIGS. 1A to 1C illustrate various perspective views of an example of a suction generation device 10. The suction generation device 10 including a fluid inlet including an array of inlet fluid ports 12, and a suction inlet 14. The suction inlet 14 is defined by a housing 16, and the array of fluid ports 12 is located on a surface of the housing 16. The housing 16 includes a cavity 18 therein. Here, the housing includes both an exterior surface and an inner surface, with the interior surface defining the shape of the cavity 18 located inside the housing 16. Here, the array of inlet fluid ports 12 is located on the interior surface of the housing. Having array of inlet fluid ports 12 located on an interior surface of the housing may reduce the likelihood of any of the inlet fluid ports 12 becoming blocked, for example by particulate matter such as that which the suction generation device 10 is designed to remove from a submerged surface. In addition, having the inlet fluid ports 12 located on an interior surface of the housing may reduce the likelihood of any of the inlet fluid ports 12 sustaining impact damage as a result of being in close proximity with the submerged surface. This may be particularly relevant in scenarios where the submerged surface is uneven and/or includes sharp/hard surfaces.

In this example, the suction inlet 14 is elongate and rectangular in shape, and spans the entire length of the housing 16. However, it should be understood that other shapes of suction inlet are also possible, some of which may not span the entire length of the housing 16. For instance, the suction inlet 14 may have the shape of an elongate oval. In another example, the suction inlet 14 may not be one continuous opening in the housing, buy may be discontinuous (e.g. formed from openings). Such openings may be any desired shape such as rectangular, polygonal or round/oval shaped.

The suction inlet 14 additionally includes a lip 28 in this example, which protrudes from the exterior surface of the housing 16. The lip may assist to stir up or dislodge particulate matter that is located on a submerged surface, to increase the ability of the suction generation device 10 to remove particulate matter from a surface. In addition the lip 28 may provide the effect of guiding a fluid from a location external to the suction generation device 10, additionally increasing the ability of the suction generation device 10 to remove particulate matter from a surface.

As is clearly illustrated in FIG. 1A, inside the cavity 18 is located in the fluid inlet ports 12, and in this example, each includes a nozzle. The nozzle allows each of the inlet ports 12 to direct a flow of fluid into the cavity, permitting each nozzle to function as an ejector nozzle. The nozzles are positioned on each of the inlet ports 12 and the fluid flow from each is parallelly directed. Having multiple inlet ports 12, each directing a parallel stream of fluid, may increase the ejector effect of the nozzles by decreasing the pressure reduction at the suction inlet 14. Furthermore, having parallelly directed nozzles may have a synergistic effect, to more efficiently use a fluid source to produce a reduction in pressure at the suction inlet 14.

Each of the inlet ports 12 in FIG. 1A are evenly spaced, which may produce an even reduction in pressure across the suction inlet 14. However, in some examples the inlet ports 12 may have a grouped arrangement (e.g. arranged in evenly spaced groups of 2, 3, 4 or more ports 12), which may be produce a more desirable pressure profile in cases where the suction inlet 14 is included of multiple ports.

The inlet ports 12 shown in FIG. 1A are illustrated in a linear array, which may assist to provide an even pressure profile (e.g. a reduction in pressure) across the suction inlet 14. However, in another example, the inlet ports 12 may be in the form of a rectangular array, e.g. there may be a second row of inlet ports 12 located adjacent the row illustrated to form a rectangular array of inlet ports 12. In some examples, a rectangular array of inlet ports 12 may include three or more rows. Having a rectangular array of inlet ports may provide benefits to the level of suction that is able to be generated at the suction inlet 14, and may additionally reduce the risk of the suction generation device 10 becoming inoperable due to blockages of individual inlet ports 12.

To provide a flow of fluid to the inlet ports 12, the suction generation device 10 includes an inlet flow connector 20. In some examples, the inlet flow connector 20 may be considered to form part of the suction generation device 10. The inlet flow connector 20 may assist to guide a fluid from a source to the fluid inlet ports 12. The inlet flow connector 20 may assist to guide a flow of fluid to the inlet ports 12 and the flow is evenly distributed between each of the inlet ports 12. At least part of the inlet flow connector 20 may be in the form of a conduit. In some examples, the inlet flow connector 20 may have a circular cross-section at one end, and transition to a rectangular cross-section at the other end. In other examples, the inlet flow connector 20 may have a uniform circular cross-section. In this example the inlet flow connector is coupled to the housing 16. In some examples, the inlet flow connector 20 is coupled to one or more surfaces (e.g. exterior surfaces) of the housing 16. In the illustrated example of FIGS. 1A-C, the inlet flow connector 20 includes a conduit connection point 22 for permitting connection of the inlet flow connector 20 to a source of fluid. The conduit connection point 22 may be considered to be located at or towards a proximal end 24 of the suction generation device while the inlet ports 12 may be considered to be located towards a distal end of the suction generation device 10. In this example, the inlet flow connector 20 extends from the proximal end 26 to the distal end, and connects to the suction generation device 10 at the distal end. In some examples, the inlet flow connector 20 may connect to an exterior surface of the suction generation device 10 on which the fluid ports 12 are located. The inlet flow connector 20 may optionally connect to further exterior surfaces of the housing 16 in order to provide greater stability to the suction generation device 10.

At the proximal end of the suction generation device 10 is located an expulsion outlet 34. A flow path is defined in the housing 16 between the fluid inlet ports 12 and the expulsion outlet 34. In use, a fluid may flow from the fluid inlet ports 12, and from the suction inlet 14, and into the flowpath in the direction of the expulsion outlet 34. The expulsion outlet 34 includes an aperture, which defined by the walls of the housing. In some examples, the expulsion outlet 34 may include one single aperture in the housing 16, while in other examples the expulsion outlet may include outlets. The expulsion outlet 34 may permit a fluid with particulate matter entrained therein, and which has flowed through the flowpath in the cavity 18, to exit the suction generation device 10. In some examples, the fluid may simply exit the suction generation device and be deposited immediately thereafter. In other examples, a connection arrangement, such as a connection conduit, may be connected to the expulsion outlet 34, and may direct an expelled fluid from the expulsion outlet to a desired location, which may be on an offshore vessel, for example. The size of the expulsion outlet may vary depending on the size of the desired matter to be collected. For example, where the particulate matter to be collected is granular, such as sand, the expulsion outlet 34 may not be required to be as wide as for other situations, for example where the matter to be collected is sea urchins or other sea pests.

Figure 2A:
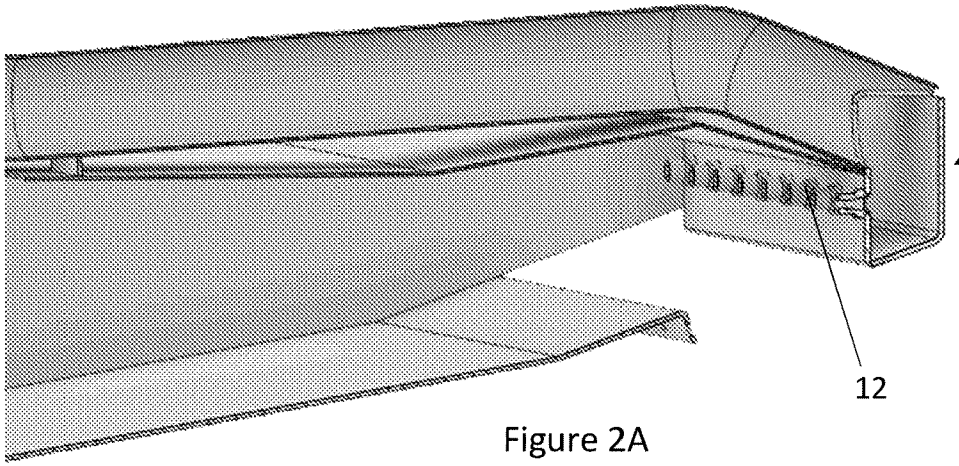
FIG. 2 shows some sectional views of a suction generation device.
Figure 2B:
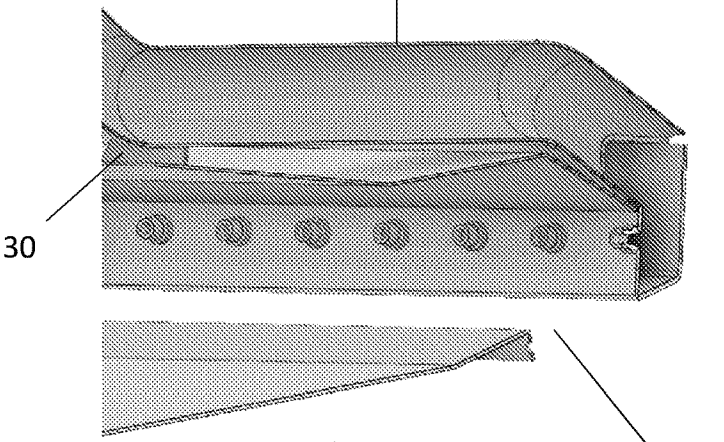
Figure 2C:
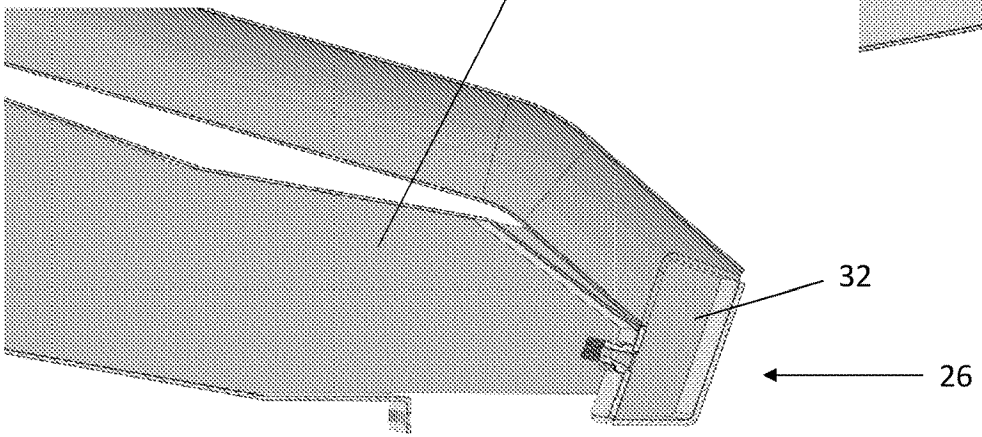

Further detail of the interior of the distal end 26 of the suction generation device 10 are illustrated in FIGS. 2A-C. Here, a sectional view is provided to permit further detail of the interior of the suction generation device 10 to be illustrated. In this example, the inlet flow connector 20 includes a uniform circular cross-section, and may be considered to be in the form of a section of conduit. The inlet flow connector 20 includes a linkage 30 to an exterior surface (in use, an upper exterior surface) of the housing 16, which may assist to hold the inlet flow connector 20 in a desired position in use. Positioned at the fluid inlet, and defined by the housing 16, is an inlet manifold 32. In this example, the inlet manifold 32 is configured to engage with the inlet flow connector 20, to permit fluid communication between the inlet flow connector 20 and the inlet manifold 32. In operation, the inlet manifold received a flow of fluid from the inlet flow connector 20, and directs the flow of fluid to the inlet fluid ports 12. In some other examples, the inlet flow connector 20 may connect directly to the inlet fluid ports 12, or may itself include a manifold for distributing a flow of fluid to the inlet fluid ports 12. In these examples, a manifold may not be required to be located in the housing 16 of the suction generation device 10 itself, but may be located on the inlet flow connector 20.

In the cross-sectional example of FIGS. 2A-C, more detail of the cavity 18 is visible. As is visible, the height and cross-sectional area of the cavity 18 increases from the distal end 26 of the cavity to the proximal end 24. The cavity 18 may therefore be shaped to encourage the pressure of a flow of fluid to increase and the velocity to decrease as the fluid travels form the distal end 26 to the proximal end 24 of the cavity (as the fluid is directed from the distal end to the proximal end by the nozzles at each fluid inlet port 12). As such, the geometry of the cavity 18 may assist to maximize the effect of the suction at the suction inlet 14 as the suction generation device 10 is operated.

As can be most clearly seen in FIG. 2C, the fluid inlet 12 is configured to direct a fluid from the fluid inlet 12 located at the distal end 26 of the device 10 towards an expulsion outlet 34, which is located at the proximal end 24 of the device 10. The suction inlet 14 is located on a lower surface of the device 10, which in this example is located obliquely relative to the surface on which the fluid inlet 12 is located (e.g. at an angle of between 90 and 180 degrees). The nozzles on each of the fluid inlet ports are configured to direct a flow of fluid in a direction away from the suction inlet 14 and into the cavity 18. As such, the fluid flowing from the nozzles will flow past the suction inlet 14 at an oblique angle, and will assist to cause a reduction in pressure at the suction inlet 14 while preventing or restricting fluid flow from the fluid inlets 12 flowing out of the suction inlet 14.

According to an example embodiment there is provided an operation apparatus for the suction generation device of the first aspect, including: a connection profile for connecting the suction generation device thereto; a fluid supply conduit for supplying a fluid to the suction generation device; a drive arrangement for engaging a submerged surface and propelling the operation apparatus along the submerged surface; and the suction generation device is connected to the operation apparatus and the suction inlet is positioned adjacent the submerged surface, and is configurable to remove matter from the submerged surface through the suction inlet as the drive arrangement propels the operation apparatus along the submerged surface.

Figure 3:
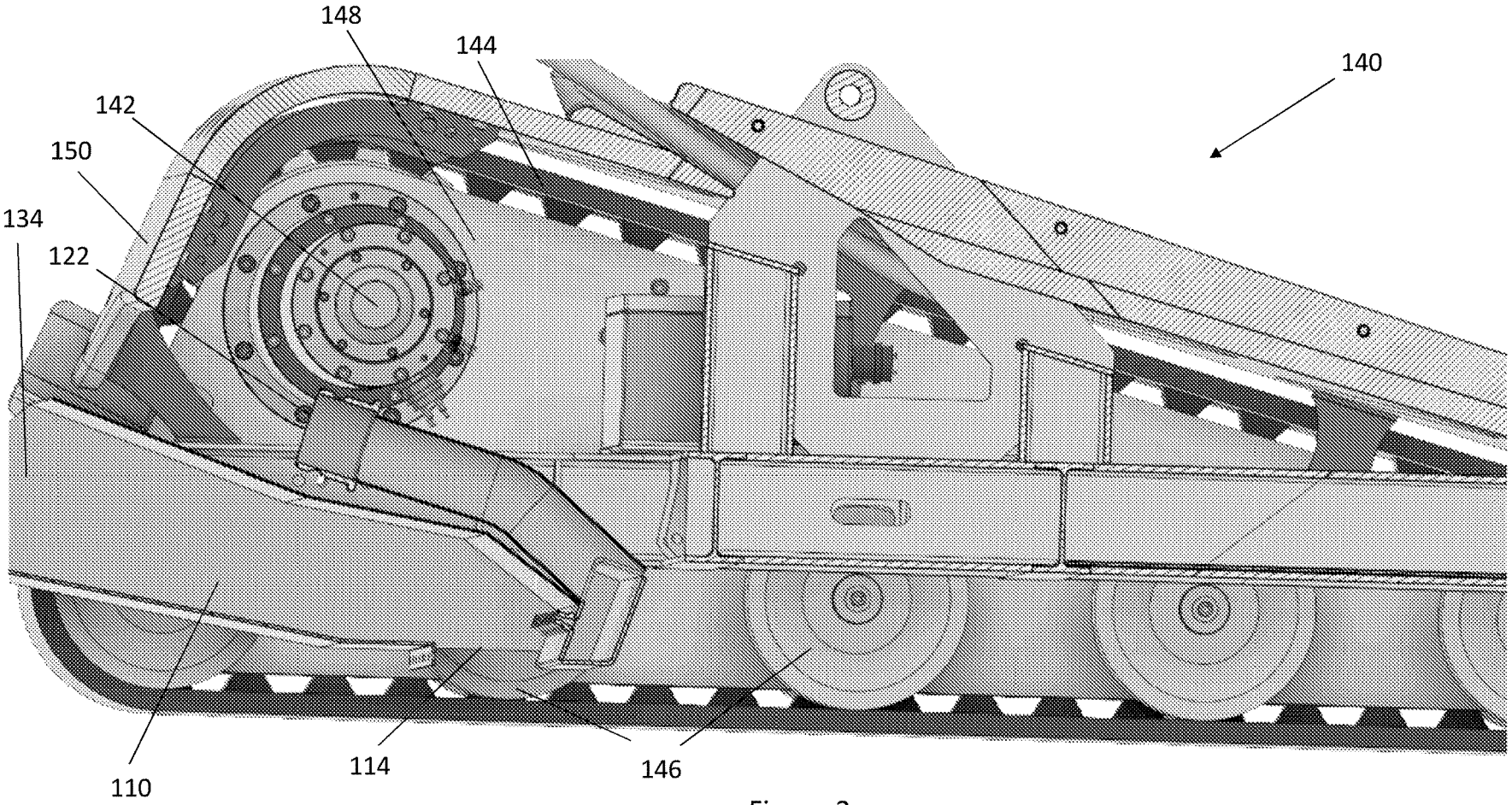
FIG. 3 is a sectional view of an operation apparatus having the suction generation device of FIGS. 1 and 2 incorporated therein.

FIG. 3 illustrates an example of an operation apparatus 140 for a suction generation device 110. Some features described in relation to this example are similar to those described in relation to the examples in FIGS. 1A-1C, and 2A-2C. As such, alike features have been given alike reference numerals, increased by 100.

According to this example, the operation apparatus 140 is in the form of a robotic device. The operation apparatus 140 includes drive means, which in this example is in the form of a motor 142 with an associated drive mechanism for driving an endless belt 144. The drive mechanism includes rollers 146, which may support the endless belt 144 as it is driven by the motor 142 to propel the operation apparatus 140 along a submerged surface. In some examples, the operation apparatus 140 may include more than one set of an endless belt 144 and rollers 146 that may, for example, be arranged with the endless belts 144 of each extending in a parallel configuration (e.g. and each endless belt is arranged parallel to each other endless belt).

The rollers 146 may be simple rollers, in that they do not have any drive capability of their own, and instead are moved by virtue of their contact with the endless belt 144, as it is driven by the motor 142. In some other examples, the rollers 146 may have additional drive, or braking capabilities. As can be seen in FIG. 3, the rollers are aligned and an outer circumference of each of the rollers lies approximately in the same plane, which may be a horizontally oriented plane in operation. As such, when the drive endless belt 144 contacts the rollers 146, a flat surface is formed (e.g. a flat horizontal surface) between each of the rollers, as well as between a first and a last of the rollers 146 (e.g. the first of the rollers may be that located leftmost as in FIG. 3, while a last of the rollers may be that located rightmost in FIG. 3).

In order to improve grip on a surface, the endless belt 144 may include a tread on a surface intended to come into contact with a submerged surface, for example, the ground or the seabed. This surface may be considered to be the outer surface of the endless belt 144.

Here, the motor 142, rollers 146 and endless belt 144 are supported by a frame 148. The frame additionally supports a guard housing 150. The guard housing 150 may function to protect and/or shield the apparatus 140 from submerged debris, which may fall on the apparatus 140, or parts thereof such as the motor 142, frame, or endless belt 144. The guard housing 150 may be located to as to cover an upper portion of the apparatus 140. A portion, which may be a lower portion, of the apparatus 140 may be free of the guard housing 150, allowing the rollers 146, or at least a part thereof, and at least a portion of the endless belt 144 to extend from the housing, to permit contact with a submerged surface.

With the operation apparatus 140 in the orientation in which it is to be used, each of the rollers 146 are aligned and the endless belt 144 is engaged between each of the rollers 146 and a submerged surface. The motor 142 is configurable to engage the endless belt 144 and drive the endless belt 144 to propel the operation apparatus 140 along a submerged surface, while the operation apparatus 140 is supported on the submerged surface by the rollers 146. Having an endless belt may permit the operation apparatus 140 to be propelled over a large variety of surface types, such as uneven surfaces, an unstable surface, a sandy or silty surface, or the like.

Coupled to the operation apparatus 140 is a suction generation device 110, as described in relation to the previous Figures. In the orientation in which the operation apparatus 140 is intended to be used, and as is illustrated in FIG. 3, the suction inlet 114 of the suction generation device 110 is located and the area of the suction inlet 114 is configured to be adjacent to (e.g. parallel to, or at an angle of less than 90 degrees relative to) a submerged surface when the apparatus 140 is in operation. The suction inlet 114 may be located and no part of the operation apparatus is located between the suction inlet 114 and the submerged surface. For example, the suction inlet 114 may be arranged to be offset from the endless belt 144 (e.g. laterally offset) and the positioning of the endless belt 144 does not interfere, or minimally interferes, with the operation of the suction generation apparatus 110, or the suction inlet 114 may be arranged and it is located at a part of the apparatus 140 that is free of the guard housing 150 (e.g. a lower portion), and the suction inlet 114 is able to protrude from the housing 150, to permit the apparatus 140 to provide more effective suction.

Although not illustrated, the apparatus 140 may include a collection pipe or vessel for collecting the fluid and any solids (e.g. particulate matter) that may be entrained therein that are produced from the expulsion outlet 134. Additionally not shown, the apparatus 140 may include a fluid supply, such as a supply of water (e.g. seawater, freshwater, or the like) attached to the connection point 122, and the suction generation device 110 is able to function as described in the previous figures.

The invention claimed is:

1. A suction generation device for removal of matter from a submerged surface, comprising:

a housing comprising an array of a plurality of fluid inlet ports, a suction inlet, an expulsion outlet, the housing having an interior surface defining a shape of a cavity therein, the housing further having an exterior surface;

the plurality of fluid inlet ports being located on said interior surface of the housing and configurable to direct a supply of fluid into the cavity and to establish a flowpath from the plurality of fluid inlet ports the expulsion outlet, the flowpath extending through the cavity, and fluid flow in the flowpath generating a reduction in pressure at the suction inlet so as to generate a flow of fluid therethrough and into the flowpath, wherein the suction inlet comprises a lip protruding from the exterior surface of the housing for directing a fluid flow into the cavity and dislodging matter located on the submerged surface.

2. The suction generation device of claim 1, wherein each of the plurality of fluid inlet ports comprises a nozzle to direct fluid into the cavity.

3. The suction generation device of claim 1, wherein the array of fluid inlet ports is a linear array.

4. The suction generation device of claim 1, wherein the array of fluid inlet ports is a rectangular array.

5. The suction generation device of claim 1, wherein the suction inlet has an elongate shape.

6. The suction generation device of claim 1, wherein the suction inlet has a rectangular shape.

7. The suction generation device of claim 1, wherein the plurality of fluid inlet ports are located on, or defined by, a first wall of the housing, and the suction inlet is located on, or defined by, a second wall of the housing, wherein the first wall extends at right angles or an oblique angle to the second wall.

8. The suction generation device of claim 1, wherein the plurality of fluid inlet ports and the suction inlet are located at a first end of the housing, and the expulsion outlet is located at a second end of the housing.

9. The suction generation device of claim 8, wherein the first end and the second end are opposite ends of the housing.

10. The suction generation device of claim 1, wherein the plurality of fluid inlet ports directs a supply of fluid away from the suction inlet.

11. The suction generation device of claim 1, comprising a connection point for connection to an operation apparatus.

12. An operation apparatus for the suction generation device of claim 1, further comprising:

a connection profile for connecting the suction generation device thereto;

a fluid supply conduit for supplying a fluid to the suction generation device;

a drive arrangement for engaging a submerged surface and propelling the operation apparatus along the submerged surface;

wherein the suction generation device is connected to the operation apparatus such that the suction inlet is positioned adjacent the submerged surface, and is configurable to remove matter from the submerged surface through the suction inlet as the drive arrangement propels the operation apparatus along the submerged surface.

13. The operation apparatus of claim 12, wherein the drive arrangement comprises an endless belt.

14. The operation apparatus of claim 12, wherein the suction inlet of the suction generation device is positioned to be substantially parallel to the submerged surface.

15. The operation apparatus of claim 12, wherein the suction inlet is located at or on a lower submerged surface-facing region of the operation apparatus.

16. The operation apparatus of claim 12, comprising a pump to drive a fluid through the plurality of fluid inlet ports of the suction generation device.

17. The operation apparatus of claim 12, comprising a motor to drive the drive arrangement.

18. The operation apparatus of claim 12, wherein the operation apparatus is remotely operable.

* * * * *